US006419106B1

(12) United States Patent
Bebak

(10) Patent No.: US 6,419,106 B1
(45) Date of Patent: Jul. 16, 2002

(54) HAND HELD VERTICAL PAINT TRAY

(76) Inventor: Sherri J. Bebak, 56 Laurel La., Pilesgrove, NJ (US) 08098

( * ) Notice: Subject to any disclaimer, the term of this patent is extended or adjusted under 35 U.S.C. 154(b) by 0 days.

(21) Appl. No.: 09/722,158

(22) Filed: Nov. 27, 2000

(51) Int. Cl.[7] ..... B05C 21/00
(52) U.S. Cl. ..... 220/570; 220/697; 220/736
(58) Field of Search ..... 220/570, 697, 220/736; 248/349.1, 131

(56) References Cited

U.S. PATENT DOCUMENTS 2,659,096 A * 11/1953 Mencfeldowski, Jr. ..... 220/570
4,164,299 A * 8/1979 Fuhr ..... 220/570
5,054,661 A * 10/1991 Hollje ..... 220/570
5,400,916 A * 3/1995 Weber ..... 220/570
5,511,279 A * 4/1996 Ippolito ..... 220/570
5,533,228 A * 7/1996 Jarecki et al. ..... 220/570
5,727,708 A * 3/1998 Erickson ..... 220/570
5,984,129 A * 11/1999 Pasinski ..... 220/570

* cited by examiner

*Primary Examiner*—Joseph M. Moy
(74) *Attorney, Agent, or Firm*—Norman E. Lehrer

(57) ABSTRACT

A paint tray which may be held by a painter while he/she is painting is disclosed. The paint tray includes a reservoir formed by a front wall, a right wall, a left wall, a back wall, and a bottom wall. The front wall extends upwardly at a slight angle in order to form a ramp. The ramp may be used to remove excess paint from a painting tool. A handle is attached to a portion of the right wall, left wall, and back wall which extend upwardly. A hook is secured to the handle which may be held by the painter as he/she paints. Alternatively, the tray may be suspended to a structure via the hook. A tab with a notch formed therein extends generally perpendicularly from the back wall and hangs above the bottom wall. The tab is used to hold a painting tool.

2 Claims, 3 Drawing Sheets

HAND HELD VERTICAL PAINT TRAY

BACKGROUND OF THE INVENTION

The present invention is directed toward a paint tray and more particularly, toward a vertical paint tray which may be held by a person as her/she is painting.

Today, many different types of paint trays exist for holding paint to be applied to surfaces such as walls and ceilings. The most common paint tray, as commonly known in the art, is constructed having a ramped front surface, the front end of the ramp being elevated and angled downwardly as the tray extends towards the rear end. This downwardly sloping ramp commonly meets a bottom or base plate anywhere from one-third to one-half of the distance to the rear end. The elevated front end is commonly supported by L-shaped legs, which are also used for clipping the paint tray to the top rail of a step ladder or the like. These common paint trays are designed to hold paint while sitting horizontally on the floor or being horizontally attached to a ladder.

These commonly used paint trays prove to be cumbersome and time-consuming while applying paint to small areas, woodwork/trim or edging out an area. The horizontal design of these paint trays does not provide the freedom of being carried around while painting. When moving the horizontally designed paint tray, the paint shifts from side to side making the weight distribution of paint within the paint tray uneven and difficult to maneuver. As a result, paint is typically spilled anytime the painter seeks to carry the paint tray containing paint for any reasonable distance. It is time-consuming to paint small areas with most paint trays because they are resting on the floor or attached to a ladder making them stationary to a particular place. Having to go back and forth to the paint tray is a waste of time and energy when applying more paint to the brush, roller or pad. Also, the back and forth travel from the paint tray to the area being painted allows for more dripping from the paint tools resulting in unnecessary cleanup and wasted paint. The aforementioned limitations make the common horizontal and stationary design for a paint tray impractical when a painter is painting a small area and is constantly mobile as in such tasks as painting trim, woodwork or edging.

Therefore, there is a need in the art of painting for a paint tray which eliminates the problems of transporting paint trays, while still providing the desired access to a ramp design that is efficient for loading a roller, brush or edging pad with paint and simultaneously enabling the painter to be free to travel about with the paint tray in hand while completing small painting tasks that require more mobility.

SUMMARY OF THE INVENTION

The present invention is designed to overcome the deficiencies of the prior art discussed above. It is an object of the present invention to provide a vertical paint tray which may be carried by a painter as he/she paints.

This invention relates to a paint tray for holding and applying paint to small areas, edging or woodwork/trim. In accordance with the illustrative embodiments demonstrating features and advantages of the present invention, there is provided a paint tray having a front wall, a rear wall, a left wall, a right wall, and a bottom wall forming a paint reservoir. The tray has a vertical structure with a handle for carrying the paint tray vertically in one's hand while simultaneously applying paint to a surface with various painting tools. The first aspect of the paint tray is to provide a vertically extended ramp on the front of the paint tray, with a lip at the top. The ramp facilitates loading a small roller, brush or edging pad with paint while the ramp provides a place to roll off the excess paint or scrape off the excess paint on an edging pad or brush on the lip at the top of the ramp on the paint tray. Another aspect of the paint tray is the provision of a vertical embodiment with a handle on the rear wall. A painter can hold and carry the paint tray while accessing the paint reservoir with a small roller, brush or edging pad. The provision of a vertical embodiment with a handle on the rear wall enables a painter to remain in continuous motion, while simultaneously performing the act of painting to complete a paint job without the need to go back and forth to the horizontal style paint trays most commonly used.

A further aspect of the paint tray is that its unified vertical embodiment enables the paint tray to be mobile without the shifting of the paint's weight and prevents the displacement of paint over the side walls of the paint tray.

Further and additional aspects of the paint tray, which shall become apparent as the detailed description proceeds, are achieved by a vertical paint tray construction providing a more stable well or paint reservoir because of its square like unitary vertical embodiment for holding paint as it is carried along while painting. The paint reservoir has four vertical walls with the front wall extending higher and more forward in a slightly inclined but very vertical position providing a ramp for a roller, edging pad or brush. The back wall and the rear of the left and right walls all join together and extend upward and forward over the center of the paint reservoir where they all extend forward to form a tool-holding tab, thereby completing the extension of the three walls. A notch formed in the tab is used for storing/holding a small roller, brush or edging pad while not in use thus preventing tools from sitting in the paint reservoir soaking up unnecessary paint which then makes the painting tools messy and often unusable. The tool-holding tab holds the tools over the center of the paint reservoir and allows the paint tools to drip directly into the paint reservoir, preventing paint waste and unnecessary cleanup. The top of the handle has a hanging hook located at the center of gravity for hanging the paint tray on a ladder. The hook gives the painter options for function as a stationary or mobile paint tray. The hook also provides the painter with a quick means to free up his/her hands while still on the ladder. The hook may also be used as a means of keeping the paint tray off the floor where it is easily tripped over. The hook extends above the tool-holding tab. The handle attached to the back outer wall is for carrying as well as holding the paint tray securely while rolling the roller or pushing painting tools against the ramp.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

REFERENCE NUMERALS IN THE DRAWINGS

Figure 1:
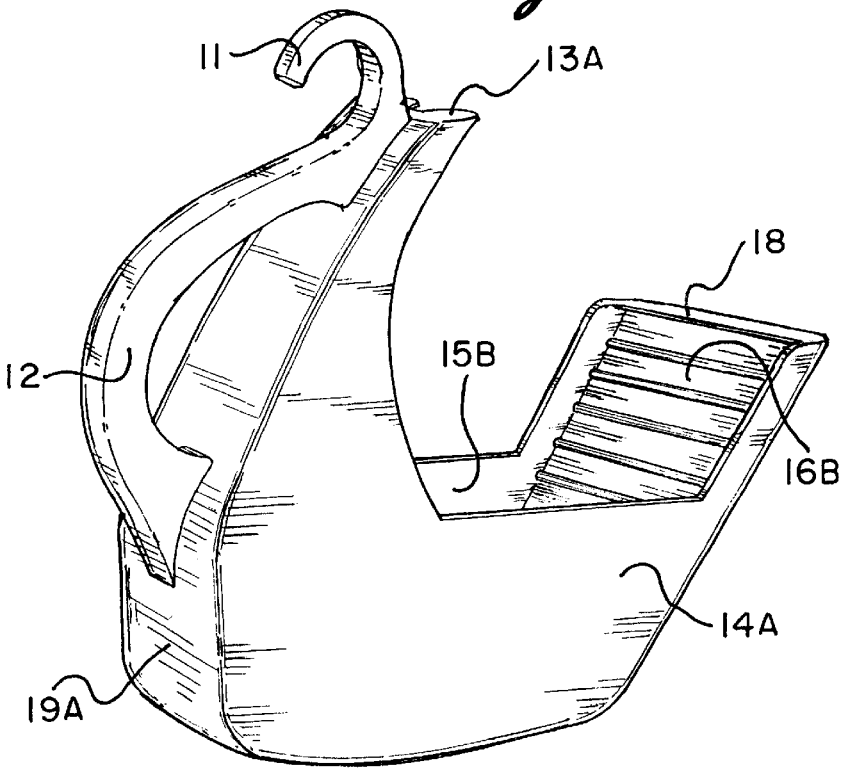
FIG. 1 is a perspective view of the present invention.

In the drawings, parts that are the same but are referred to as (inside) and (outside) have the same numbers but different alphabetical suffixes.

| | |
|---|---|
| 11 | hook |
| 12 | handle |
| 13 A | tool holding tab (outer part) |
| 13 B | tool holding tab (inner part) |
| 14 A | right wall (outside) |
| 14 B | right wall (inside) |
| 15 A | left wall (outside) |
| 15 B | left wall (inside) |
| 16 A | vertically extended ramp (outside) |
| 16 B | vertically extended ramp (inside) |
| 17 A | floor of the paint reservoir (outside) |
| 17 B | floor of the paint reservoir (inside) |
| 18 | lip |
| 19 A | back wall (outside) |
| 19 B | back wall (inside) |

DETAILED DESCRIPTION OF THE PREFERRED EMBODIMENT

Referring now to the drawings in detail wherein like reference numerals have been used throughout the various figures to designate like elements, there is shown in FIG. 1 a vertical paint tray constructed in accordance with the principles of the present invention.

The paint tray of the present invention essentially includes a paint reservoir having a front wall, a left wall, a right wall, a bottom wall or floor, and a back wall. The back wall (outer) 19A has a handle 12 positioned in the upper center for better weight distribution to the hand while holding the paint tray. A hook 11 atop the handle 12 and the handle 12 are both positioned at the center of gravity at the top of the paint tray. FIG. 1 shows a partial view of a tool holding tab (outer part) 13A positioned above the center floor or bottom wall of the paint reservoir so that paint-filled tools will drip directly into the paint reservoir. FIG. 1 shows right wall (outside) 14A and left wall (inside) 15B and the vertically extended ramp (inside) 16B with the lip 18 at the top of the ramp. The ramps extends to a position above the top of the reservoir.

The ramp extends upwardly from the bottom front of the paint reservoir. In the inside 16B part of the ramp, approximately half way up the ramp are small humps or rounded edges that project outwardly from the ramp. The humps are spaced approximately one half inch apart and run from right side to left side where the humps stop about one half inch in from both sides of the ramp as well as one inch down from the lip on the top of the ramp. (See FIG. 1.)

Figure 2:
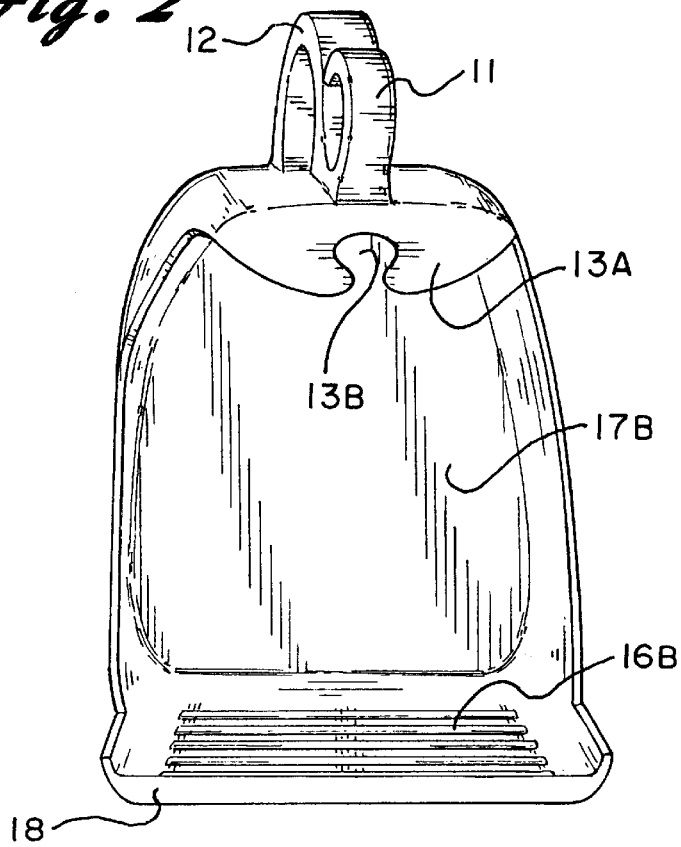
FIG. 2 is a top perspective view of the present invention.

FIG. 2 shows the tool holding tab (outer part) 13A and its tool holding tab (inside) 13 B or notch. The tab is positioned at the top of the handle 12 over the floor of the paint reservoir (inside) 17B. The hook 11 curves backward directly over the top of the handle 12. FIG. 2 also shows the vertically extended ramp (inside) 16B and how it extends upward from the floor of the paint reservoir (inside) 17B to the lip 18 of the paint tray at the top of the ramp.

Figure 3:
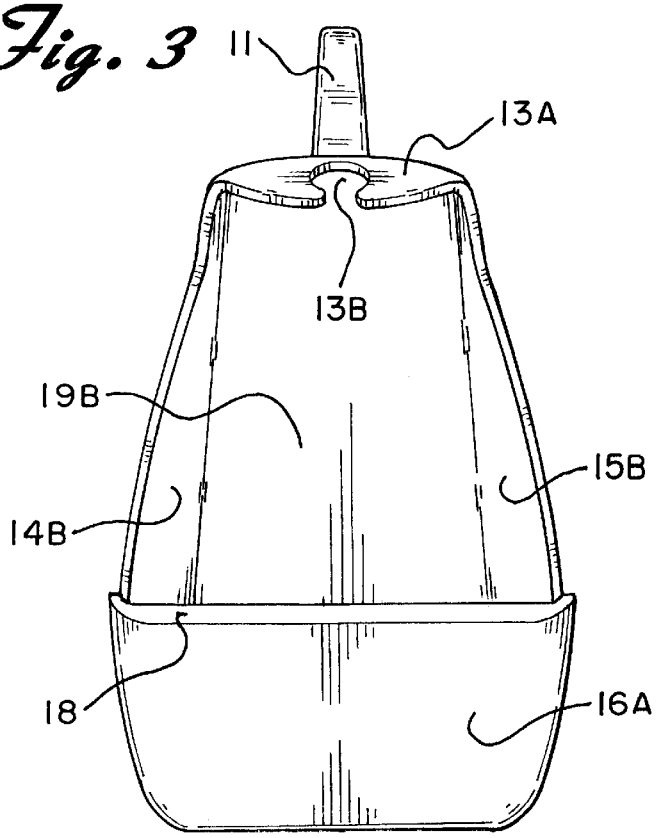
FIG. 3 is a top plan view of the present invention.

FIG. 3 shows the vertically extended ramp (outside) 16A and the lip 18 on the top of the ramp. FIG. 3 shows right wall (inside) 14B and left wall (inside) 15B extending upwardly in the rear connecting to the back wall (inside) 19B. The three connected walls extend around to form the tool holding tab 13A. The tool-holding tab (inner part) 13B is a continuous piece with a notch out of it. FIG. 3 also shows how the hook 11 is positioned directly behind the tool-holding tab (inner part) 13B.

Figure 4:
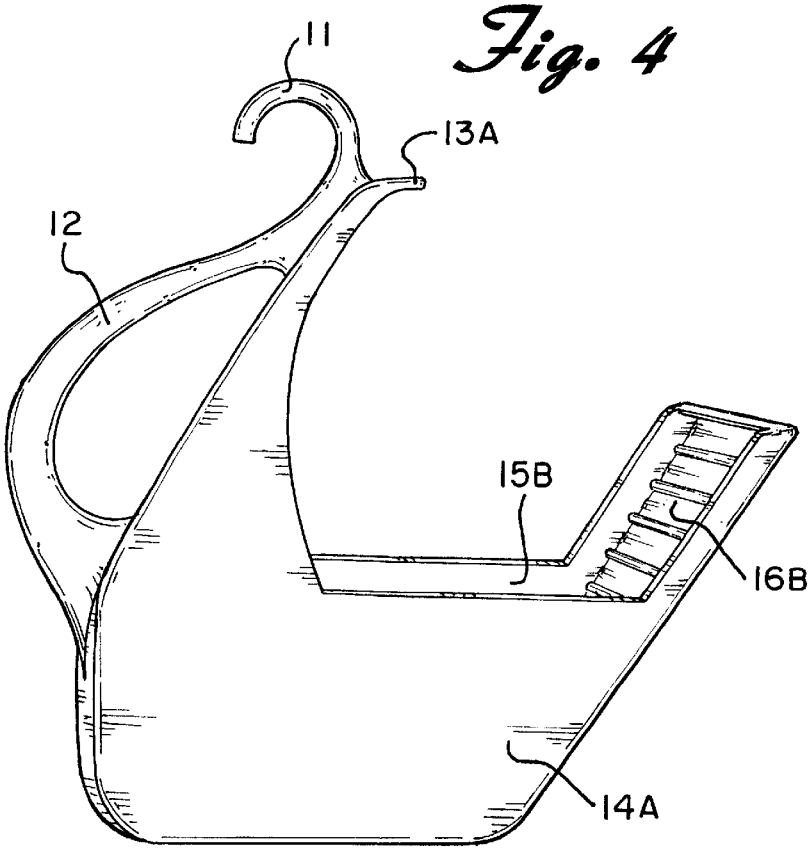
FIG. 4 is a right side elevational view of the present invention.

FIG. 4 shows right wall (outside) 14A connecting to the vertically extended ramp (inside) 16B and the ramp connecting to the left wall (inside) 15B. FIG. 4 also shows how the right wall (outside) 14A extends upwardly as it connects with the tool holding tab (outer part) 13 A. The handle 12 is positioned where both side walls start extending upwardly toward the hook 11 and the tool holding tab (out side) 13A at the top of the handle 12.

Figure 5:
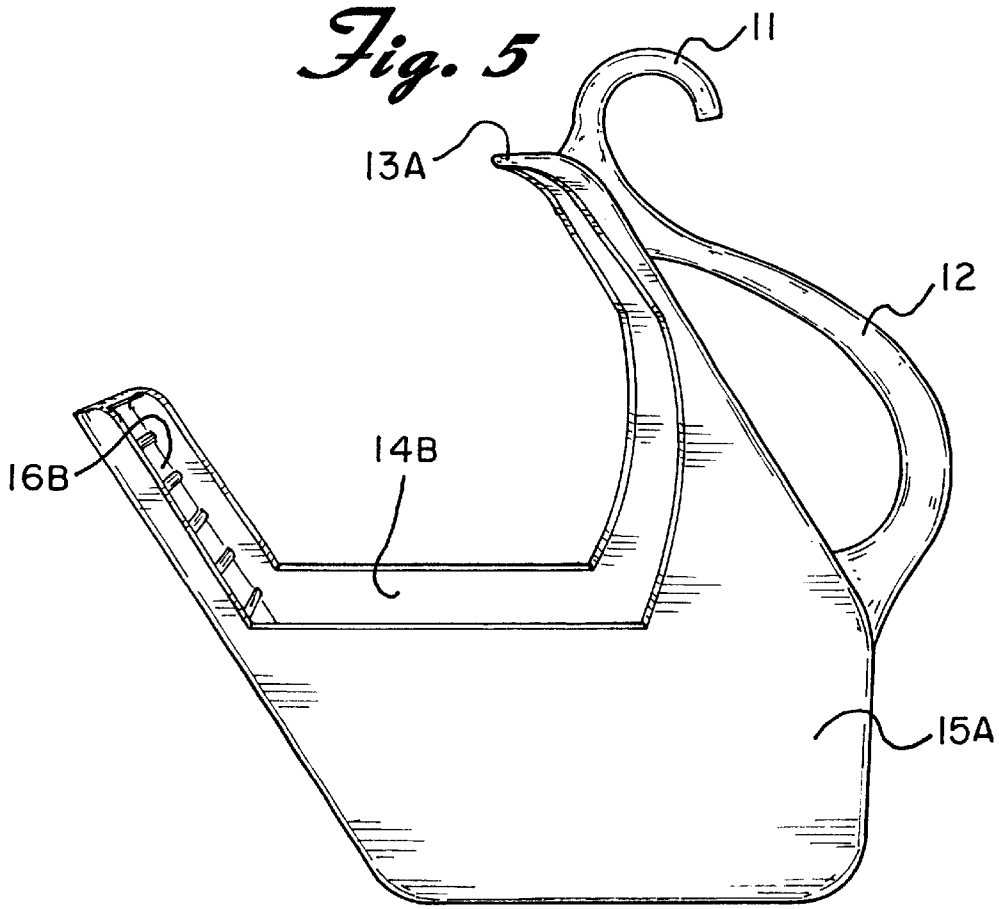
FIG. 5 is a left side elevational view of the present invention.

FIG. 5 shows the left wall (outside) 15A connecting to the vertically extended ramp (inside) 16B and the ramp connecting to the right wall. FIG. 5 also shows how the left wall (outside) 15A extends upwardly as it connects with the tool holding tab (outer part) 13A. The handle 12 is positioned where the sidewalls start extending upwardly toward the hook 11 and the tool holding tab (outside) 13A at the top of the handle 12.

Figure 6:
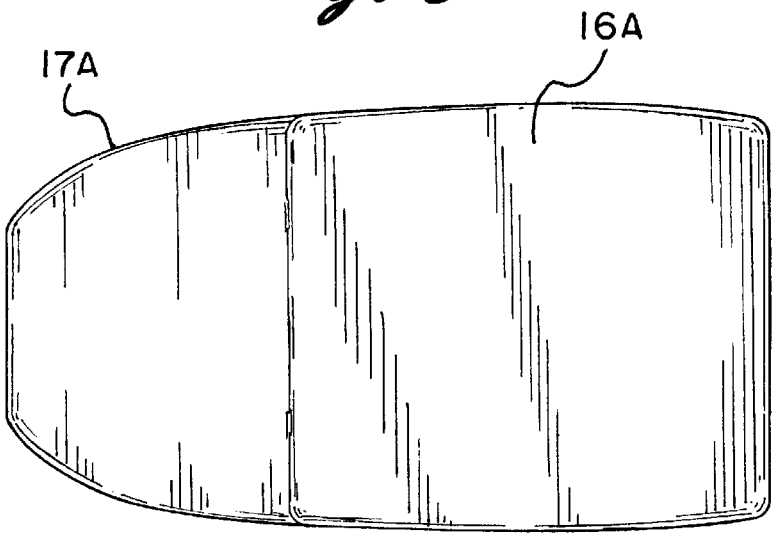
FIG. 6 is a bottom plan view of the present invention.

FIG. 6 is a view of the invention lying on its side with the vertically extended ramp 16 A facing the viewer. The floor of the paint reservoir (outside) 17A curves around from the vertically extended ramp (outside) 16A and goes backward to the square like paint reservoir which is angling slightly inward at the rear. FIG. 6 shows both the vertically extended ramp (outside) 16A and the floor of the paint reservoir (outside) 17A.

The primary operation of the paint tray is to allow the painter to hold the paint tray in one hand while painting with the other hand, making the paint tray easily accessible at all times during a task where the painter needs to be mobile or in constant motion. The mobility of the paint tray makes it extremely efficient in that there is less time and energy exerted by the painter while performing a task that requires mobility. The paint tray is unitarily molded, lightweight and easily maneuvered. There are no moving parts to get in the way and jostle about while maneuvering around using the paint tray. The paint tray eliminates needless traveling back and forth from the area being painted to a stationary paint tray, thereby saving time and energy. There is less waste and mess made by the paint as it drips off of tools, due to the paint tools remaining with the paint tray.

FIG. 1 clearly illustrates the main function of the paint tray, which is to be able to carry the tray single-handed while painting. FIG. 1 is a perspective view clearly showing the paint tray's vertical structure of its square unitary embodiment in which paint is carried about during the course of a painting task. In particular, the task of edging out a small space, woodwork/trim or windows requires a painter to use small tools. The horizontal designs that other paint trays offer are cumbersome, time consuming and often create a good deal of clean up. The vertical and mobile design of my paint tray introduces a much more efficient means to apply paint to smaller trimming and edging type tools used in the painting trade of today. FIG. 1 shows the square unitary shape of the paint tray, which limits the weight distribution of the paint as it moves side-to-side in the paint reservoir. By limiting the side-to-side shifting of weight the paint becomes more stable in the paint reservoir. FIG. 1 gives a clear view of the vertical depth by showing the right wall (outside) 14A and the left wall (inside) 15B and how both walls extend upward along the vertically extended ramp (inside) 16B. FIG. 1 shows the right wall (outside) 14A meeting the back wall (outside) 19A and how they both extend vertically [upward] to the hook 11 and the tool holding tab 13A at the top of the vertical paint tray above the height of the ramp.

FIG. 4 shows the right wall (outer) 14A and FIG. 5 shows the left wall (outer) 15A and the placement position of the handle 12 and how both right and left walls extend upwardly in a vertical design. FIG. 1 is a perspective view of the placement of the handle 12 on the back wall (outer) 19A and clearly shows that the paint tray is designed for use in a vertical manner, this is unlike other paint trays designed to be used horizontally on a floor or mounted. FIGS. 1–5 show the vertically extended paint ramp 16A and 16B and its upward design opposed to other horizontally designed paint trays.

Secondary functions of the paint tray are clearly viewed in FIG. 2. At the top of the handle 12 is the hook 11 and tool-holding tab (outer) 13A positioned directly behind the hook 11 on the top of the paint tray and extending generally perpendicularly from the back wall. The main functions of the hook 11 and the tool-holding tab (outer) 13A are primarily a means of convenience, providing a way to save time and energy exerted by a painter. While painting, the hook 11 can be used to perform several tasks that are functional and convenient. The placement of the hook 11 allows the painter to free up hands in an instant by allowing the painter to hang the paint tray easily, thereby saving a painter the time it takes to have to find a flat surface to place the paint tray. The hook 11 is simple to use by a painter using one hand to place the hook 11 over an object. While hanging, the paint tray remains stable enough to continue painting from it with a roller, brush or edging pad. The hook 11 makes the paint tray convenient for a painter to employ more than one tool to while painting on a ladder without the need to descend the ladder to unhand the paint tray.

As shown in FIG. 2 the tool-holding tab (outer) 13A is a functional, convenient way to hang various painting tools. During the act of painting, a painter can hang a painting tool on the tool-holding tab 13A where it remains accessible for further use. The tool-holding tab 13A has been placed directly over the floor of the paint reservoir 17B where the paint that drips from the tool is neatly and conveniently deposited into the paint reservoir. The tool-holding tab 13A saves time for a painter by supplying a quick and easily accessible way to unhand painting tools without having to travel elsewhere. By using the tool-holding tab 13A painter is afforded the luxury of always knowing where to retrieve the painting tools.

Thus, the reader will clearly see in the aforementioned descriptions that not only is the vertical design of the paint tray convenient, but a necessity in saving a painter's time and energy by providing new functions with more productive and versatile ways to use a paint tray to accommodate the large spectrum of painting tools available in today's market. The handle 12 provides secure mobility and is the primary function of the paint tray. The handle 12 saves time and energy by eliminating the need to travel back and forth to a stationary paint tray in order to apply more paint to painting tools. Clean up is also minimized because much of the dripping paint is prevented when travel is eliminated. The square shaped vertical embodiment of the paint reservoir keeps the paint stable enough to prevent spilling over the sides. The lightweight composition enables the painter to carry and easily maneuver the paint tray in one hand while painting with the other. Embodiments such as the hook 11 and tool holding tab 13A add even more time, energy, convenience and versatility to the paint tray's capabilities. The hook 11 is a quick and convenient way to unhand the paint tray in a safe and secure manner. While hanging, the tray is still stable enough to use paint tools on the paint ramp. The tool-holding tab offers efficient function to the painter by simply providing a place to hang the painting tools where the tools stay clean and free of excess paint while dripping neatly into the paint reservoir. The composition of the paint tray makes this invention reusable for a multitude of times, easy to clean, and recyclable if discarded. In conclusion, the mobility of the *Hand Held Vertical Paint Tray* will provide painters with a more productive and versatile method to use a paint tray with small rollers, brushes and edging tools.

The present invention may be embodied in other specific forms without departing from the spirit or essential attributes thereof and accordingly, reference should be made to the appended claims rather than to the foregoing specification as indicating the scope of the invention.

I claim:

1. A vertical paint tray comprising:

a generally square reservoir for holding paint including a back wall, a right wall, a left wall, a front wall, and a bottom wall, said front wall including a ramp extending upwardly and at an angle from said reservoir to a position above the top of said reservoir, said back wall extending upwardly above the height of said ramp;

a handle secured to the outside of said back wall;

a hook attached to the top of said handle for suspending said paint tray; and a tab with a notch formed therein for holding a painting tool, said tab extending generally perpendicularly from the top of said back wall and above said bottom wall.

2. The paint tray of claim 1 wherein said ramp has a lip and a series of rounded edges for removing excess paint from a painting tool.

* * * * *